US006622504B2

(12) United States Patent
Lee et al.

(10) Patent No.: US 6,622,504 B2
(45) Date of Patent: Sep. 23, 2003

(54) APPARATUS AND METHOD FOR CONTROLLING COOL AIR IN REFRIGERATOR

(75) Inventors: In Won Lee, Gyeonggi-do (KR); Jay Ho Choi, Seoul (KR); Seong Ho Cho, Seoul (KR); Young Sok Nam, Seoul (KR); In Seop Lee, Seoul (KR); Jae Yong Sung, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/176,574

(22) Filed: Jun. 24, 2002

(65) Prior Publication Data

US 2003/0140641 A1 Jul. 31, 2003

(30) Foreign Application Priority Data

Jan. 28, 2002 (KR) ..... 2002-4886

(51) Int. Cl.[7] ..... F25D 17/04; F25D 11/02
(52) U.S. Cl. ..... 62/186; 62/441
(58) Field of Search ..... 62/186, 440, 441, 62/408, 448

(56) References Cited

U.S. PATENT DOCUMENTS 3,866,437 A * 2/1975 Spencer ..... 62/408
4,662,186 A * 5/1987 Park ..... 62/265
5,097,675 A * 3/1992 Elsom et al. ..... 62/408

* cited by examiner

*Primary Examiner*—Melvin Jones
(74) *Attorney, Agent, or Firm*—Greenblum & Bernstein, P.L.C.

(57) ABSTRACT

The invention relates to a cool air controlling apparatus for concentrically cooling a region in a refrigerator where a new load is stored. The apparatus comprises: the first cool air duct provided along a compartment wall of a refrigerator with a certain length for allowing the cool air introduced from a blowing chamber to flow therethrough; the second cool air duct having a variable length provided downward from a front end of the first cool air duct; length adjusting means connected to the second cool air duct for adjusting the length of the second cool air duct; and rotation adjusting means attached to a lower end of the second cool air duct for carrying out rotation and injecting the cool air. The entire temperature distribution is uniformly maintained in a refrigerating chamber thereby greatly reducing power consumption.

28 Claims, 7 Drawing Sheets

APPARATUS AND METHOD FOR CONTROLLING COOL AIR IN REFRIGERATOR

BACKGROUND OF THE INVENTION

1. Field of the Invention

The present invention relates to a refrigerator, and more particularly, to an apparatus for controlling cool air to concentrically cool a region in the refrigerator which is weakly cooled or stores a new load.

2. Description of the Related Art

In general, a-refrigerator is used for freezing foods or keeping the same in cold storage.

The refrigerator is an apparatus which deprives heat from the surroundings for cooling the same through a refrigerating cycle composed of air compressing, air condensing and evaporating steps in order to freeze or refrigerate foods which tend to rot in warm areas and fishes required for keeping freshness.

Due to its convenience that the refrigerator can store or store foods, fishes, fruits, drinks and the like as well as freeze the same into edible ices at any time based upon the above principle, the refrigerator becomes an essential electric instrument in the modem society.

FIG. 1 is a perspective view illustrating the structure of a typical refrigerator. Referring to FIG. 1, the refrigerator is divided into a freezing chamber 24 and a refrigerating chamber 26 about a compartment wall 18 of a body 14. At least one door (not shown) is mounted to the front in order to separate the freezing and refrigerating chambers 24 and 26 from the external air.

In the meantime, the refrigerator comprises instruments for the refrigerating cycle which perform the compressing, condensing and evaporating steps to generate cool air necessary for cooling the freezing and refrigerating chambers 24 and 26. Further, the refrigerator is provided at an upper rear region thereof with a blowing chamber 10 which has an air blowing fan 12 for forcibly blowing the cool air generated in the refrigerating cycle into the freezing and refrigerating chambers 24 and 26.

Further, a plurality of cool air forward-discharge ports 20*a* for discharging the cool air forward are formed in certain positions of the compartment wall 18 between the freezing and refrigerating chambers 24 and 26 which mutually communicate with the blowing chamber 10.

Further, a cool air suction port 22 may be provided in a certain position for sucking in the surrounding air.

In the refrigerator constituted as above, a compressor compresses a gaseous coolant low with temperature and pressure into a state high with temperature and pressure. The compressed gaseous coolant high with temperature and pressure is frozen and condensed into a liquid state high with pressure while passing through a condenser. The liquid coolant high with pressure is lowered with temperature and pressure while passing through a capillary tube (not shown). Then, in an evaporator, the liquid coolant is transformed into a gaseous state low with temperature and pressure while depriving heat from the surroundings to cool the air in the surroundings. In sequence, the air cooled through the evaporator is circulated through the freezing chamber 24 and then the refrigerating chamber 26 due to the operation of the blowing fan 12 so as to lower the internal temperature of the freezing and refrigerating chambers.

As described above, the refrigerator is provided with a cool air distributing system for uniformly distributing the cool air generated around the evaporator to storage spaces of the freezing and refrigerating chambers. Of course, the cool air distributing system is variously configured according to the kind of the refrigerator.

Describing the cool air distributing system in reference to FIGS. 1 and 2, the refrigerating chamber 26 is provided in the upper end with a damper 20 which communicates with the blowing chamber 10.

On the side of the damper 20 are provided the cool air forward-discharge ports 20*a* and cool air downward-discharge ports 20*b* for discharging the cool air downward.

Therefore, in the cool air distributing system configured as above, the cool air generated around the evaporator and transferred into the blowing chamber 10 is distributed to the freezing chamber 24 and the damper 20 with the blowing fan 12 provided in the blowing chamber 10.

In this case, the cool air introduced into the freezing chamber 24 circulates through the inside of the freezing chamber before moving into the evaporator again via the cool air suction port 22 at the bottom of the freezing chamber. Then, the cool air introduced into the damper 20 is discharged into the refrigerating chamber 26 via the cool air forward-discharge ports 20*a* at the side.

The cool air discharged into an upper region of the refrigerating chamber via the cool air forward-discharge ports 20*a* is distributed to storage spaces defined by storage shelves 16 while flowing downward via spaces between a door 15 and the storage shelves 16. Then, the cool air is finally introduced into the cool air suction port 22 connected to the evaporator.

However, according to the related art as set forth above, the cool air discharged from the upper damper is not properly transferred into middle and lower regions of the refrigerating chamber far from the damper so that a refrigerating operation is not effectively carried out thereby resulting in a problem that the refrigerating chamber has a non-uniform temperature distribution.

Since the cool air is insufficiently transferred around the door 14 apart from the upper damper, foods stored in a door basket are not properly cooled as a problem.

In the meantime, the conventional refrigerator configured as above discharges or blocks the cool air into/from the refrigerating chamber 26 by detecting the weight of the shelves 16 in the refrigerating chamber 26 stored with new load (e.g. food) or the weight of the refrigerating chamber 26 itself. Alternatively, the refrigerator discharges or blocks the cool air into/from the entire refrigerating chamber 26 according to its temperature fluctuation by detecting and judging the temperature of the refrigerating chamber 26 itself with a temperature sensor (not shown) mounted on a specific region of the refrigerating chamber 26.

However, according to this cool air controlling method, when the surrounding temperature and weight of the refrigerating chamber are elevated due to the new load as above, the cool air is discharged into the entire refrigerating chamber for a certain time period to lower the elevated surrounding temperature of the entire refrigerator thereby disadvantageously enlarging the amount of power consumption of the refrigerator.

Further, the controlling method of cooling the entire refrigerating chamber as above cools the newly stored load while lowering the temperature of the entire refrigerating chamber, thereby degrading the cooling speed of the new load and the cooling ability of the refrigerator with the cool air by a large amount as drawbacks.

SUMMARY OF THE INVENTION

Accordingly the present invention has been made to solve the above problems of the related art and it is an object of the invention to provide an apparatus for controlling cool air in a refrigerator.

It is another object of the invention to provide an apparatus for concentrically cooling a region which stores a new load.

According to a preferred aspect of the invention to obtain the above objects, it is provided an apparatus for discharging cool air comprising: the first cool air duct provided along a compartment wall of a refrigerator with a certain length for allowing the cool air introduced from a blowing chamber to flow therethrough; the second cool air duct having a variable length provided downward from a front end of the first cool air duct; length adjusting means connected to the second cool air duct for adjusting the length of the second cool air duct; and rotation adjusting means attached to a lower end of the second cool air duct for carrying out rotation and injecting the cool air.

The apparatus of the invention may further comprise temperature-detecting means provided in the rotation adjusting means for detecting surrounding temperature.

In the apparatus of the invention, the second cool air duct is preferably shaped as a bellows.

In the apparatus of the invention, the length adjusting means may comprise: moving means for vertically moving the second cool air duct; and a winch motor provided in a front end of the second cool air duct for winding up the moving means, wherein the moving means may be a cable or rope, and the winch motor may be connected to a drum for winding or unwinding the moving means via a shaft.

In the apparatus of the invention, the rotation adjusting means may comprise: a cool air injection nozzle for injecting the cool air; and driving means having a rotor and a stator for rotating the cool air injection nozzle, wherein the rotor is preferably provided on the side of the cool air injection nozzle.

According to another preferred aspect of the invention to obtain the above objects, it is provided an apparatus for controlling cool air in a refrigerator comprising: a blowing chamber having a blowing fan for compressing the cool air; a damper penetrating a compartment wall and leading for a certain length to introduce the cool air from the blowing chamber; and cool air discharging means which moves from the front of a refrigerating chamber to the position of a load to discharge the introduced cool air.

According to further another preferred aspect of the invention to obtain the above objects, it is provided a system for controlling cool air in a refrigerator comprising: varying means for operating in all directions according to opening/closing of a refrigerator door; detecting means for detecting surrounding temperature according to the operation of the varying means; controlling means for judging whether the detected surrounding temperature reaches a certain degree or higher to control injection of the cool air; and cool air discharging means for injecting the cool air in the front of a refrigerating chamber if the detected surrounding temperature reaches the certain degree or higher.

In the system of the invention, wherein the varying means may comprise: a cool air duct having a vertically variable length; length adjusting means connected to the cool air duct for adjusting the length of the cool air duct; and rotation adjusting means attached to a lower end of the cool air duct for carrying out rotation and injecting the cool air.

The system of the invention may further comprise an auxiliary duct provided along a wall on the side of a damper of a refrigerator chamber and communicating with the cool air duct.

According to still another preferred aspect of the invention to obtain the above objects, it is provided a method of controlling cool air in a refrigerator, the method comprising the following steps of: operating varying means in all directions according to opening/closing of a refrigerator door; if the varying means are operated in all directions, detecting surrounding temperature to judge whether the surrounding temperature reaches a predetermined degree or higher; and if the surrounding temperature reaches the predetermined degree, injecting the cool air.

In the method of the invention, the step of operating varying means may comprise the steps of: vertically moving a cool air duct; and rotating a cool air injection nozzle attached to the cool air duct, wherein the cool air duct may be moved by using a winch motor, and the cool air injection nozzle may be rotated by using driving means.

In the method of the invention, the driving means may have a rotor and a stator.

In the method of the invention, the cool air can be injected based upon the detected surrounding temperature while the-varying means is operated if the refrigerator door is not opened/closed for a certain time.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
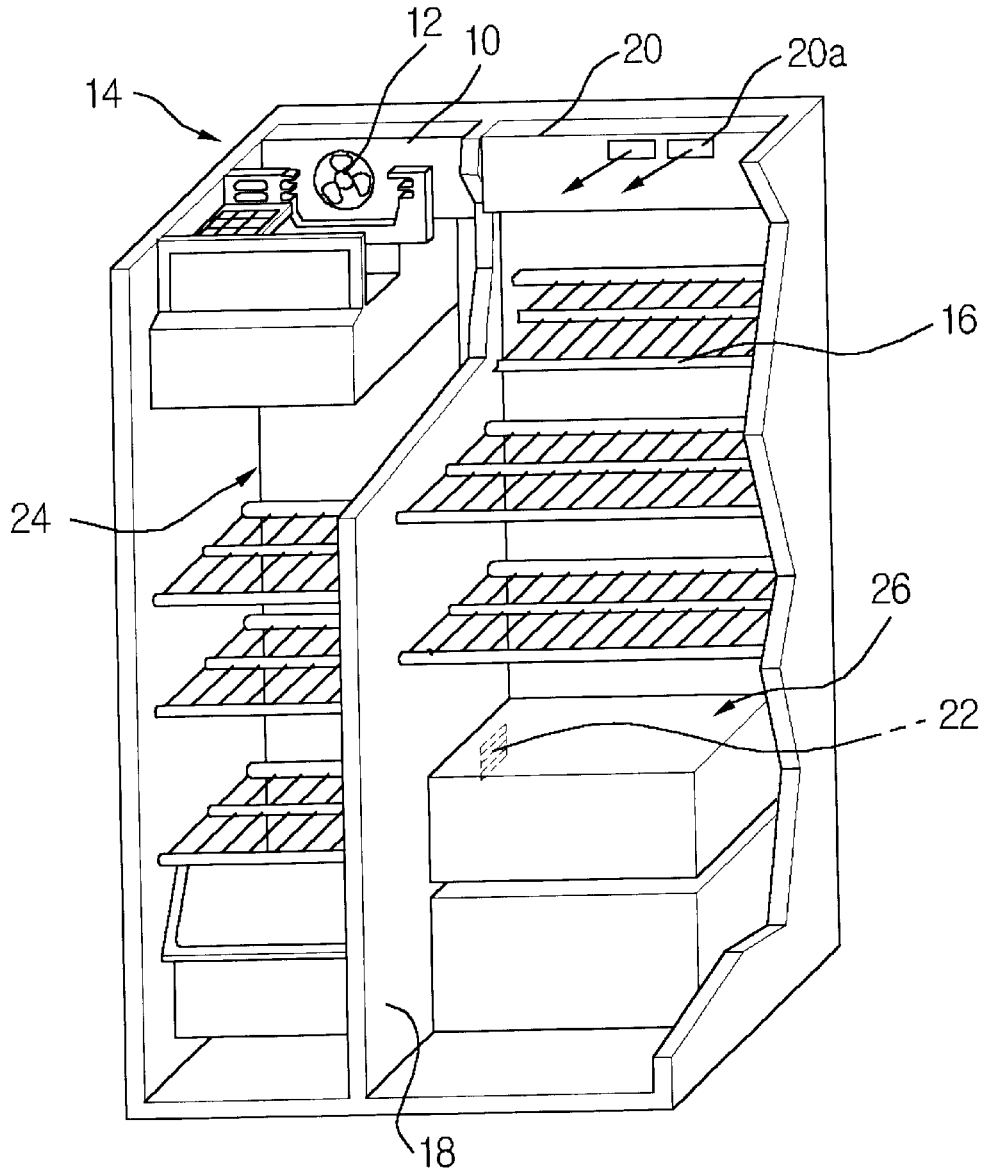
Fig. 1(Related Art)
FIG. 1 is a perspective view illustrating the structure of a general refrigerator.
Figure 2:
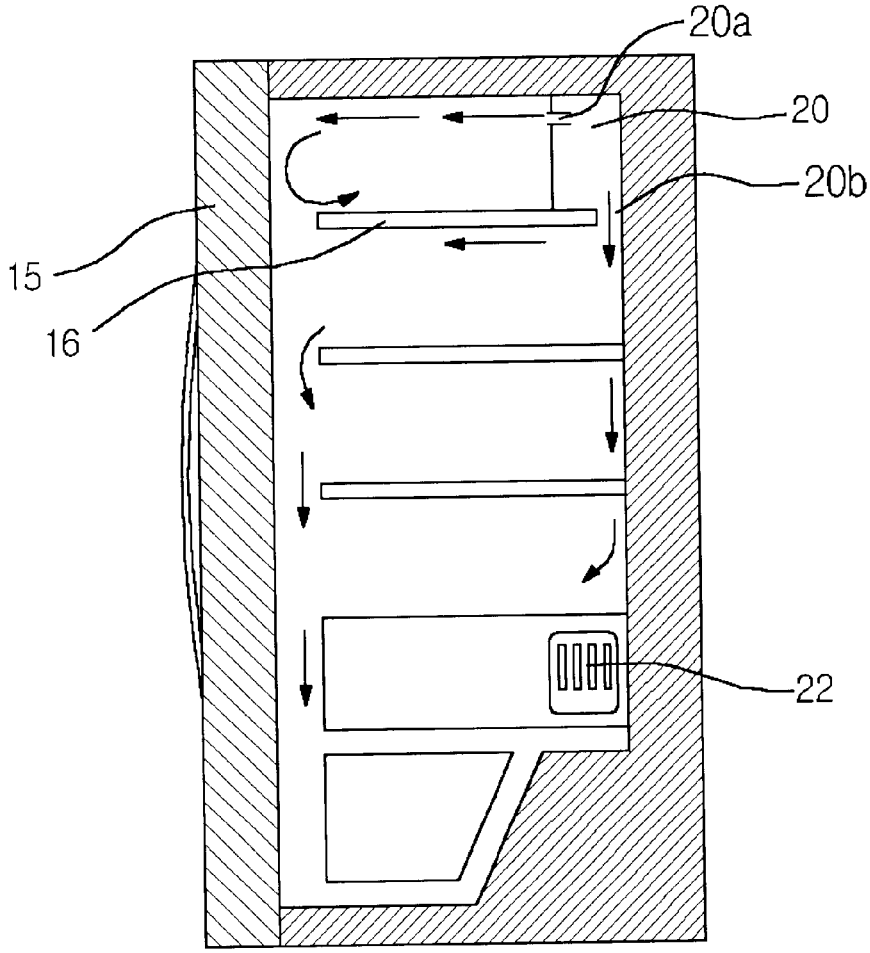
Fig. 2(Related Art)
FIG. 2 is a schematic sectional view illustrating cool air circulation according to a conventional cool air distributing system.

The following detailed description will present a preferred embodiment of the invention in reference to the accompanying drawings, in which well-known functions or constructions will not be described in detail since they may unnecessarily obscure the concept of the invention. Throughout the drawings of the invention, the same reference numerals used in the related art are used to designate the same or similar components for the convenience's sake of explanation The present invention is characterized in detecting the surrounding temperature inside a refrigerator after a refrigerator door is opened/closed and injecting cool air into a region having a surrounding temperature reaching a predetermined degree or higher.

Figure 3:
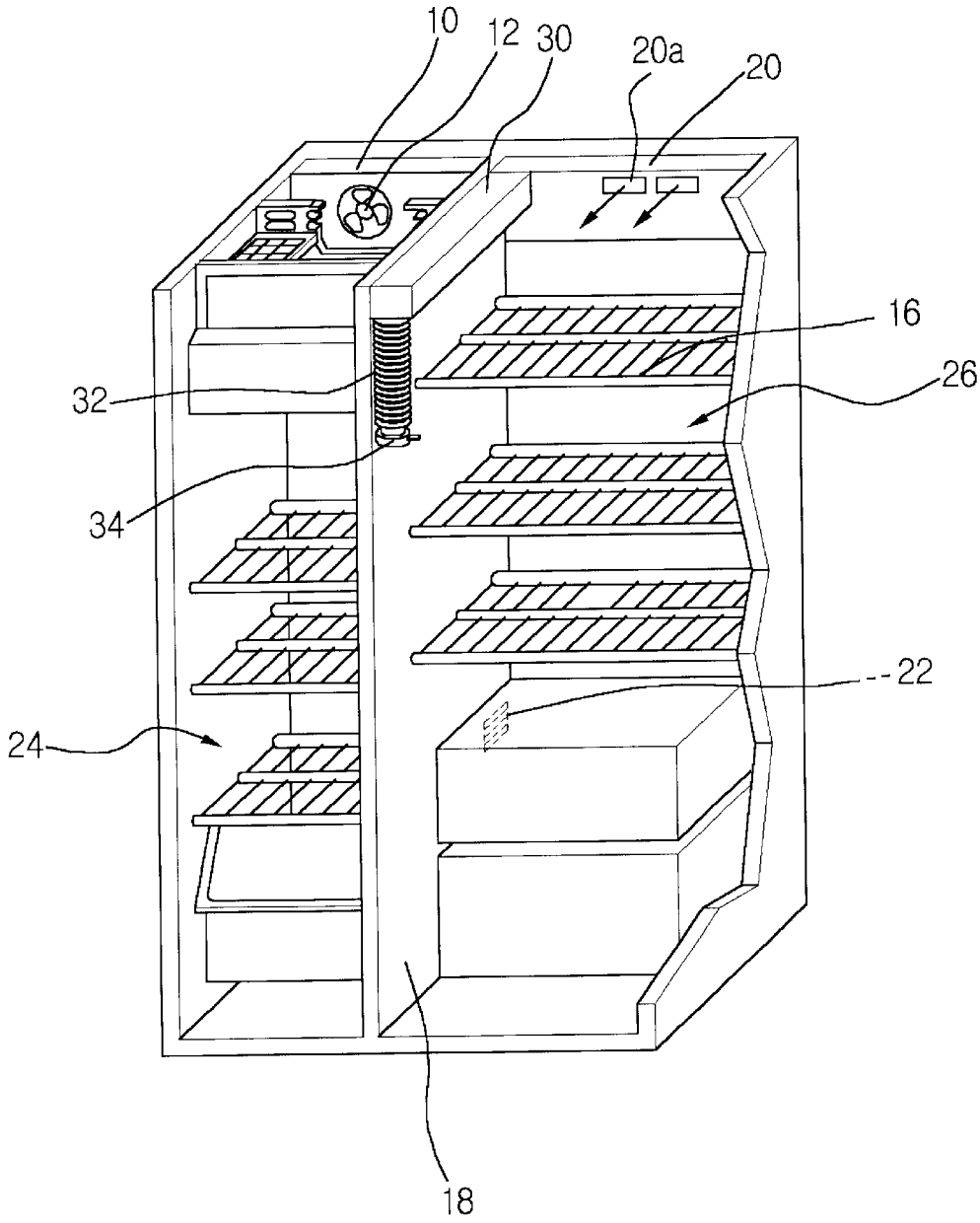
FIG. 3 is a perspective view illustrating the structure of a refrigerator adopting a cool air controlling apparatus according to a preferred embodiment of the invention.
Figure 4A:
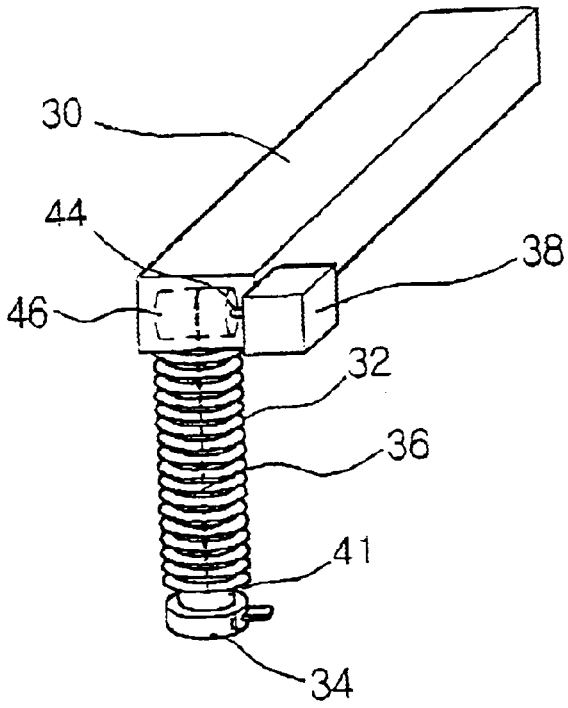
FIGS. 4A and 4B illustrate the structure of the cool air discharging means shown in FIG. 3.
Figure 4B:
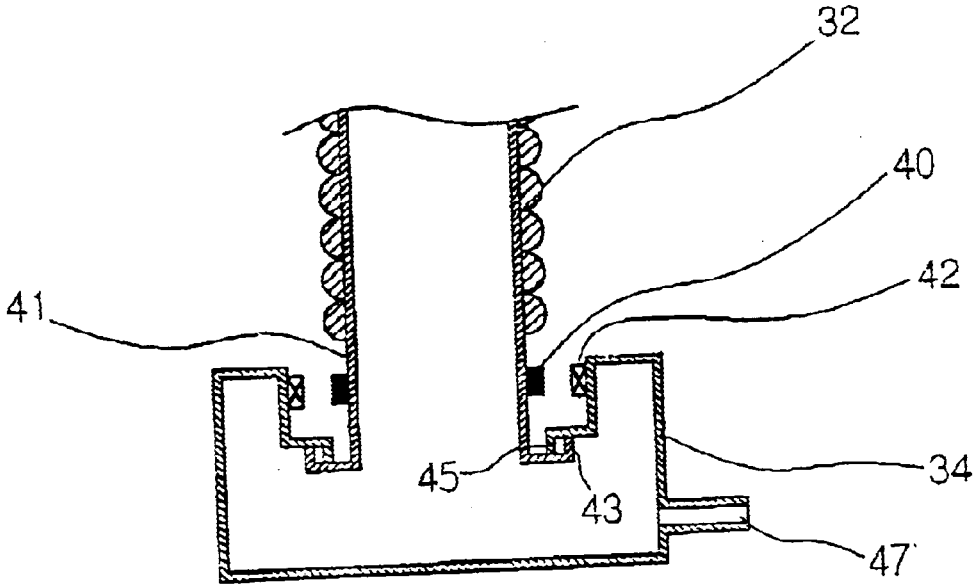

FIG. 3 is a perspective view illustrating the structure of a refrigerator adopting a cool air controlling apparatus according to a preferred embodiment of the invention, and FIG. 4 illustrates the structure of cool air discharging means shown in FIG. 3.

Referring to FIG. 3, the cool air controlling apparatus comprises a blowing chamber 10, a damper 20 and cool air discharging means.

The blowing chamber 10 is provided on the entrance side with a blowing fan 12 for compressing cool air and sending the compressed cool air to the damper 20.

The damper 20 penetrates a compartment wall 18 between a freezing chamber 24 and a refrigerating chamber 26 so that the cool air may flow in from the blowing chamber 10, and leads as long as the lateral distance of the rear wall of the refrigerating chamber 26.

The cool air discharging means comprises the first cool air duct 30, the second cool air duct 32, length-adjusting means and rotation-adjusting means.

The first cool air duct 30 is provided on the side of the compartment wall 18 along the same from one side of the damper 20, and leads as long as the lateral distance of the compartment wall 18.

The second cool air duct 32 is variable in its length and arranged downward from the front end of the first cool air duct 30. In this case, it is required that the second cool air duct 32 if fixedly installed at the front end of the first cool air duct 30 so that the cool air may not leak outward. Preferably, the second cool air duct 32 is an extensible tube shaped as a bellows so that the length of the second cool air duct 32 can be reduced/extended.

The length-adjusting means comprises moving means 36, a drum 46 and a winch motor 38. Preferably, the moving means 36 is a cable or rope. The drum 46 is connected to the winch motor 38 and a motor shaft 44 to wind or unwind the moving means 36. The operation of the winch motor 38 rotates the motor shaft 38 connected to the winch motor 38 causing the drum 46 to wind or unwind the moving means 36 while rotating clockwise or counter-clockwise. Herein, it shall be observed that the second cool air duct 32 is equivalently varied in its length as the moving means 36 is varied in its length.

The moving means 36 is fixed at one side to the drum 46, and at the opposite side to an adaptor 41 leading from the end of the second cool air duct 32 as shown in FIG. 4. The drum 46 is provided within a duct of the front end of the first cool air duct 30, and the winch motor 38 connected thereto via the motor shaft 44 is provided outside the first cool air duct 30. In other words, the winch motor 38 is alternatively provided within the compartment wall 18 or on the side of the first cool air duct 30 opposite to the compartment wall 18.

The rotation-adjusting means includes driving means and a cool air injection nozzle 34. The cool air injection nozzle 34 is a member for injecting the cool air flowed from the blowing chamber 10. The driving means includes a stator 40 constituted of an armature coil and an iron core and a rotor 42 constituted of a plurality of permanent magnets. Herein, the stator 40 is formed along the outer circumference of the adaptor 41 in the second cool air duct 30, and the rotor 42 has the plurality of permanent magnets arranged along the inner circumference of the cool air injection nozzle 34.

When electric current is applied to the stator 40, the stator 40 is energized to rotate the rotor 42 so that the cool air injection nozzle 34 having the rotor 40 is rotated. Preferably, the end 43 of the adaptor 41 is so connected to the inner end 45 of the cool air injection nozzle 34 that the cool air may not leak outward under the rotation.

On one side around a discharge port of the cool air injection nozzle 34 is provided a temperature sensor and the like for detecting the surrounding temperature. Preferably, the temperature sensor is provided by the side of the discharge port 47.

In the meantime, although not shown in FIGS. 3 and 4, an opening/closing sensor capable of detecting the opening/closing of a refrigerator door is provided on the door side of the refrigerator and a controller is separately provided for controlling distribution of the cool air based upon the surrounding temperature in order to realize the cool air controlling apparatus.

Figure 5A:
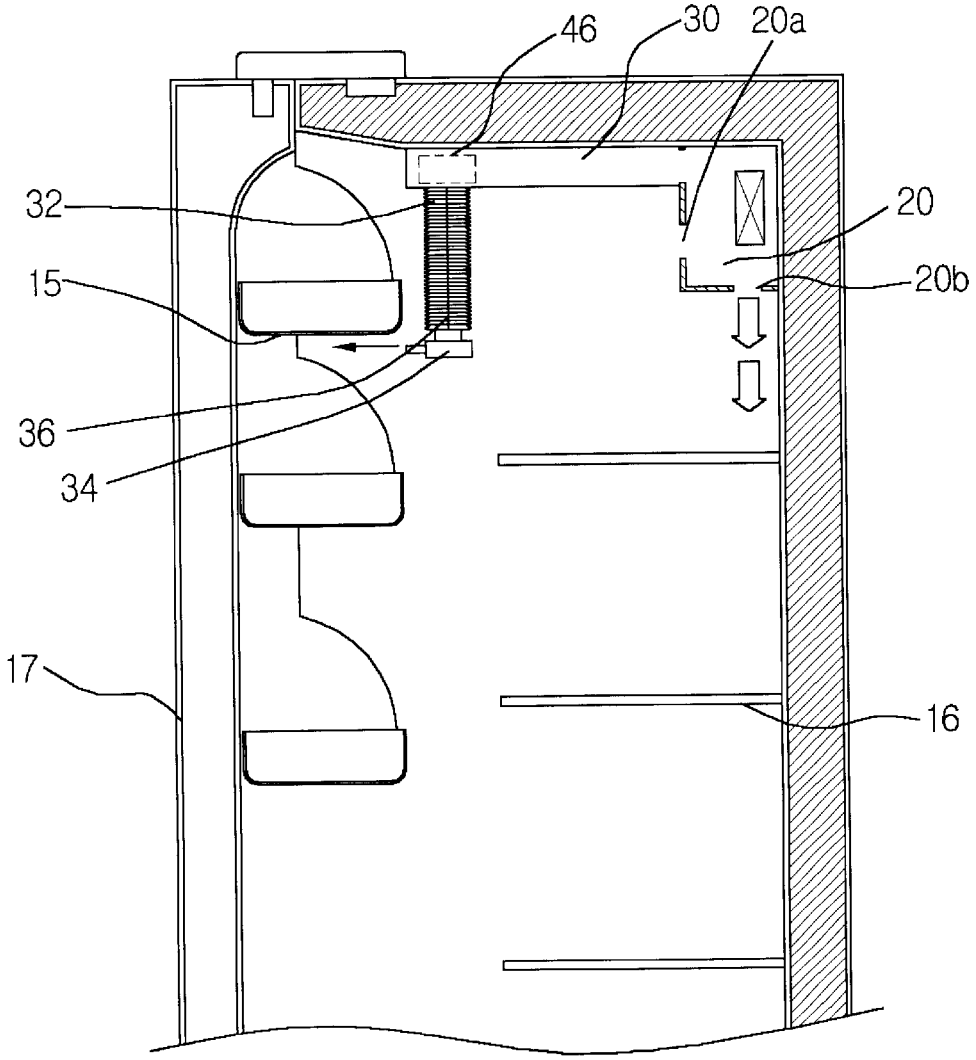
FIGS. 5A and 5B illustrate the operation of a cool air controlling apparatus according to a preferred embodiment of the invention.

Describing the operation of the invention, the discharge port 47 of the cool air injection nozzle 34 is directed toward one of door baskets 15 to inject the cool air as the second cool air duct 32 is contracted in a normal situation that the refrigerator door is not opened as shown in FIG. 5A.

Further, when the refrigerator door is not opened/closed for a certain time period, the second cool air duct 32 is extended and the cool air injection nozzle is rotated under the control of the controller to inject the cool air into a region having a temperature reaching a predetermined degree by detecting the surrounding temperature.

Figure 5B:
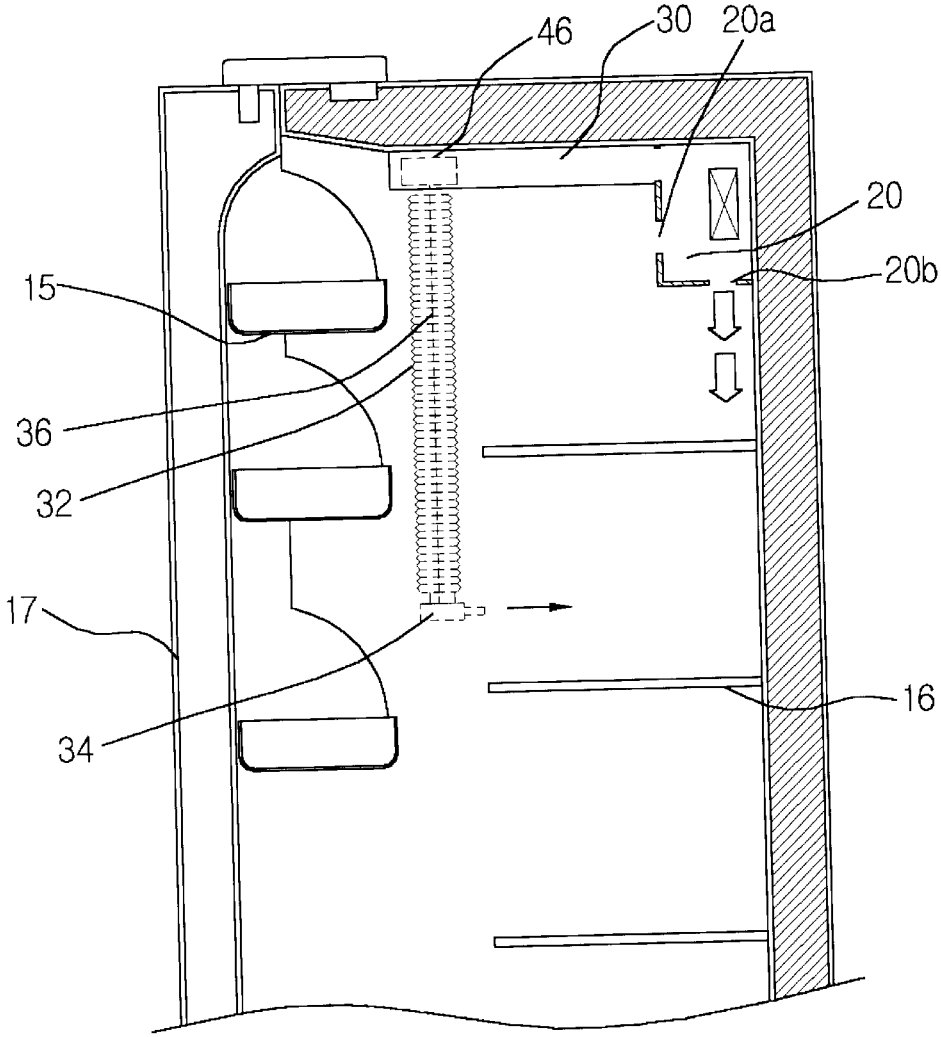

When a user opens the refrigerator door to store a new load into one the door baskets 15 or storage shelves 16, the second cool air duct 32 is extended and the cool air injection nozzle 34 is rotated, as shown in FIG. 5B, under the control of the controller detecting the opening/closing of the refrigerator door. When, the surrounding temperature detected by the temperature sensor is transferred into the controller, the controller allows cool air injection by judging whether the surrounding temperature reaches a predetermined degree. In this case, the second cool air duct 32 and the cool air injection nozzle 34 are preferably operated in the following sequence: The second cool air duct 32 is primarily extended, and the cool air nozzle 34 is rotated following the second cool air duct 32.

Further, the second cool air duct 32 may be unintermittently extended for a predetermined unit while the cool air injection nozzle 34 can be smoothly rotated in a continuous manner.

Therefore, the second cool air duct 32 is extended and the cool air injection nozzle 34 is rotated toward the region storing the new load to inject the cool air via the cool air injection nozzle 34 when the detected surrounding temperature is the predetermined degree or higher. Of course, if the new load is a cold food, the cool air is not injected since the detected surrounding temperature is under the predetermined degree.

As a result, when the refrigerator door is opened/closed to store the new load, the second cool air duct 32 and the cool air injection nozzle 34 are operated until reaching the region storing the new load, where the cool air is injected based upon the detected surrounding temperature.

The operation of the cool air controlling apparatus set forth above will be described in more detail in reference to FIG. 6.

Figure 6:
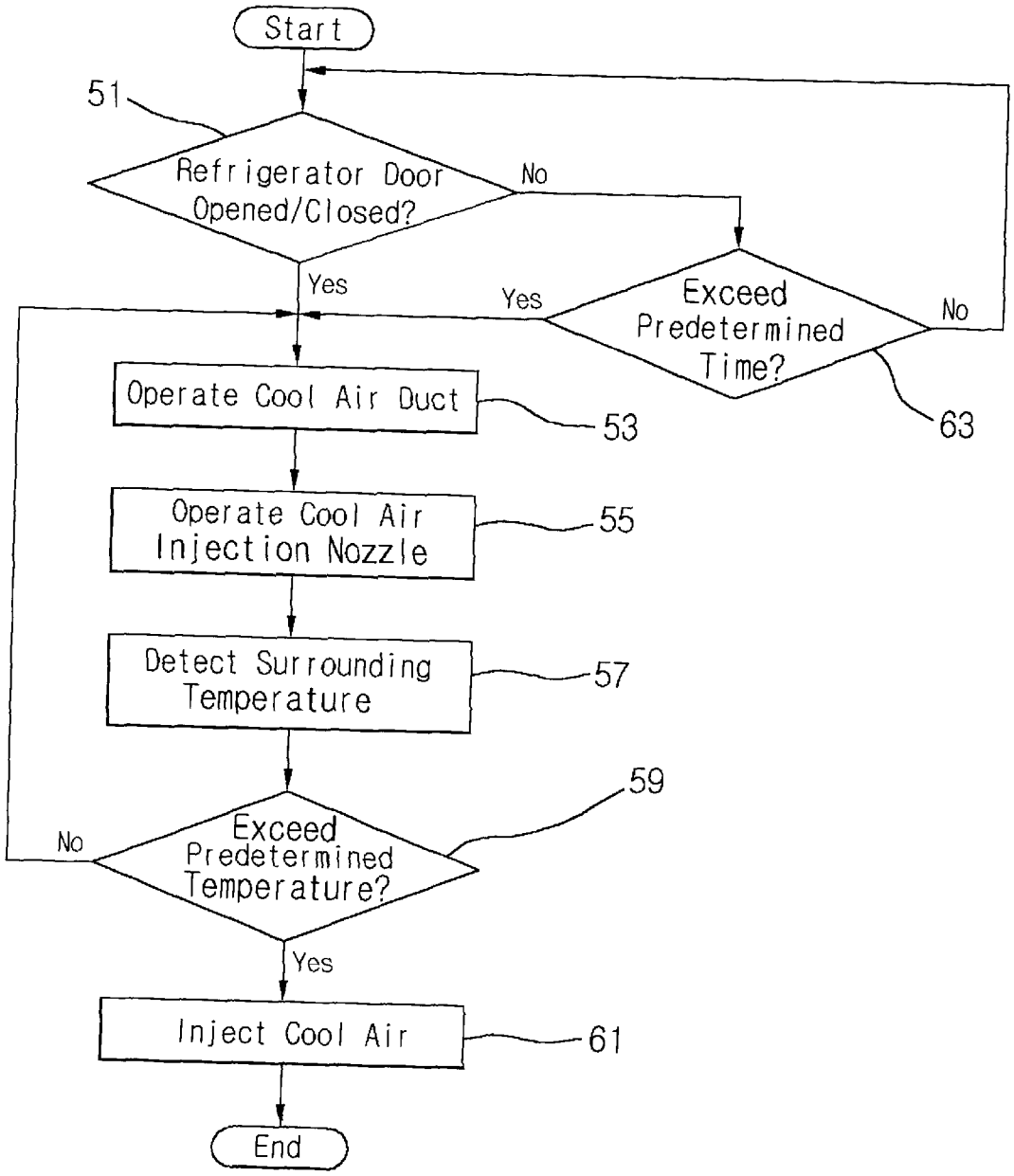
FIG. 6 is a flow chart illustrating a cool air controlling process through temperature detection in a cool air controlling apparatus according to a preferred embodiment of the invention.

FIG. 6 is a flow chart illustrating a cool air controlling process through temperature detection in a cool air controlling apparatus according to a preferred embodiment of the invention.

Referring to FIG. 6, the opening/closing sensor detects whether the refrigerator door is opened/closed in step 51. A new load may be stored or not even if the refrigerator door is opened and closed since the user may close the refrigerator door without taking something out of the refrigerator even if he/she intended so.

Upon detection of the opening/closing of the refrigerator door in step 51, the controller operates the cool air duct and the cool air injection nozzle in steps 53 and 55. The cool air duct means the second cool air duct shown in FIG. 3.

The controller extends the cool air duct for the predetermined unit and continuously rotating the cool air injection nozzle while detecting the surrounding temperature via the temperature sensor in step 55.

The controller judges whether the surrounding temperature exceeds a predetermined temperature in step 59, and if the surrounding temperature does not exceed the predetermined temperature, repeatedly carries out the above processes in steps 53 and 57.

If the surrounding temperature exceeds the predetermined temperature, the controller controls the cool air injection nozzle to inject the cool air in step 61.

Cool air injection due to step 61 is not carried out if the new load is not stored even though the opening/closing of the refrigerator door is detected in step 51 and the above processes in steps 53 to 57 are carried out.

Further, although the new load is stored, the cool air is not injected also if the load is cold and thus the temperature thereof does not exceed the predetermined temperature.

In the meantime, if the refrigerator door is not opened/closed in step 51, the controller detects a time interval between the opening/closing of the refrigerator door in step 63. If the refrigerator door is not opened/closed for a predetermined time, i.e. exceeding the predetermined time, the above processes in steps 53 to 61 are carried out. The surrounding temperature of the storage shelves or the door baskets is continuously detected so that the cool air may be injected into a region having the surrounding temperature reaching the predetermined temperature or under.

On the contrary, if the refrigerator door is opened/closed in the predetermined time, the process progresses to step 51 so that the opening/closing sensor confirms whether the refrigerator door is opened/closed.

As set forth above, the cool air controlling apparatus according to the preferred embodiment of the present invention detects the surrounding temperature to inject the cool air into a region having the temperature exceeding a predetermined degree while moving downward from an upper part of the refrigerator due to the opening/closing of the refrigerator door so that temperature distribution can be rapidly maintained uniform across the entire refrigerator even if a new load is stored.

Further, according to the invention, even if the refrigerator door is not opened/closed, the temperature is periodically detected from the entire internal area of the refrigerator to inject the cool air into a weakly cooled region thereby greatly reducing power consumption.

According to the invention, the cool air is injected as the discharge ports of the cool air injection nozzles are directed toward the refrigerator door at normal times to function as a cool air curtain for blocking hot air from the outside when the refrigerator door is opened.

The present invention enables a concentrated cooling action resulting in the temperature distribution to be uniformly maintained in the refrigerator.

What is claimed is:

1. An apparatus for discharging cool air comprising:

a first cool air duct provided along the compartment wall of a refrigerator with a certain length for allowing the cool air introduced from a blowing chamber to flow through it;

a second cool air duct having a variable length provided downward from the front end of the above mentioned first air duct;

length adjusting means connected to the second cool air duct for adjusting the length of the second cool air duct; and rotation-adjusting means attached to a lower end of the second cool air duct for carrying out the rotation and the injection of the cool air.

2. The apparatus according to claim 1, further comprising temperature detecting means provided in the rotation adjusting means for detecting surrounding temperature.

3. The apparatus according to claim 1, wherein the second cool air duct is shaped as a bellows.

4. The apparatus according to claim 1, wherein the length adjusting means comprises:

moving means for the vertical motion of the second cool air duct; and a winch motor provided in a front end of the second cool air duct for winding up the moving means.

5. The apparatus according to claim 4, wherein the moving means is a cable or rope.

6. The apparatus according to claim 4, wherein the winch motor connected to a drum for winding or unwinding the moving means via a shaft.

7. The apparatus according to claim 1, wherein the rotation adjusting means comprises:

a cool air injection nozzle for injecting the cool air; and driving means having a rotor and a stator for rotating the cool air injection nozzle.

8. The apparatus according to claim 7, wherein the rotor is provided on the side of the cool air injection nozzle.

9. An apparatus for controlling cool air in a refrigerator comprising:

a blowing chamber having a blowing fan for compressing the cool air;

a damper penetrating a compartment wall and leading for a certain length to introduce the cool air from the blowing chamber; and the cool air discharging means which moves from the front of a refrigerating chamber to the position of a load to discharge the introduced cool air.

10. The apparatus according to claim 9, wherein the cool air discharging means comprises:

a first cool air duct provided along a compartment wall of a refrigerator with a certain length for allowing the cool air introduced from a blowing chamber to flow therethrough;

a second cool air duct having a variable length provided downward from a front end of the first cool air duct;

length adjusting means connected to the second cool air duct for adjusting the length of the second cool air duct; and rotation-adjusting means attached to a lower end of the second cool air duct which rotates inject the cool air.

11. The apparatus according to claim 10, further comprising temperature detecting means provided in the rotation adjusting means for detecting surrounding temperature.

12. The apparatus according to claim 10, wherein the second cool air duct is shaped as a bellows.

13. The apparatus according to claim 10, wherein the length adjusting means comprises:

moving means for vertically moving the second cool air duct; and a winch motor provided in a front end of the second cool air duct for winding up the moving means.

14. The apparatus according to claim 13, wherein the moving means is a cable or rope.

15. The apparatus according to claim 10, wherein the winch motor is connected to a drum for winding or unwinding the moving means via a shaft.

16. The apparatus according to claim 10, wherein the rotation adjusting means comprises:

a cool air injection nozzle for injecting the cool air; and driving means for rotating the cool air injection nozzle to the position of a load.

17. A system for controlling cool air in a refrigerator comprising:

varying means for operating in all directions according to opening/closing of a refrigerator door;

detecting means for detecting surrounding temperature according to the operation of the varying means;

controlling means for judging whether the detected surrounding temperature reaches a certain degree or higher to control injection of the cool air; and cool air discharging means for injecting the cool air in the front of a refrigerating chamber if the detected surrounding temperature reaches the certain degree or higher.

18. The system according to claim 17, wherein the varying means comprises:

a cool air duct having a vertically variable length;

length adjusting means connected to the cool air duct for adjusting the length of the cool air duct; and Rotation-adjusting means attached to a lower end of the cool air duct for carrying out rotation and injecting the cool air.

19. The system according to claim 18, wherein the detecting means is provided on the side of the rotation-adjusting means.

20. The system according to claim 18; further comprising an auxiliary duct provided along a wall on the side of a damper of a refrigerator chamber and communicating with the cool air duct.

21. The system according to claim 18, wherein the length adjusting means comprises:

a cable for vertically moving the cool air duct; and a winch motor provided in a front end of the cool air duct for winding up the cable.

22. The system according to claim 18, wherein the length adjusting means comprises:

a cool air injection nozzle for injecting the cool air;

driving means for rotating the cool air injection nozzle.

23. A method of controlling cool air in a refrigerator, the method comprising the following steps of:

operating varying means in all directions according to opening/closing of a refrigerator door;

if the varying means are operated in all directions, detecting surrounding temperature to judge whether the surrounding temperature reaches a predetermined degree or higher; and if the surrounding temperature reaches the predetermined degree, injecting the cool air.

24. The method according to claim 23, wherein the step of operating varying means comprises the steps of:

vertically moving a cool air duct; and rotating a cool air injection nozzle attached to the cool air duct.

25. The method according to claim 24, wherein the cool air duct is moved by using a winch motor.

26. The method according to claim 24, wherein the cool air injection nozzle is rotated by using driving means.

27. The method according to claim 26, wherein the driving means has a rotor and a stator.

28. The method according to claim 23, wherein the foregoing steps are repeatedly carried out if the refrigerator door is not opened/closed for a certain time.

* * * * *